United States Patent [19]

Head, Jr. et al.

[11] 4,428,214

[45] Jan. 31, 1984

[54] FLOW DRILLING PROCESS AND TOOL THEREFOR

[75] Inventors: Glenn D. Head, Jr., Des Moines; William C. Le Master, Ankeny; Louis P. Bredesky, Jr.; David C. Winter, both of Des Moines, all of Iowa

[73] Assignee: Deere & Company, Moline, Ill.

[21] Appl. No.: 346,679

[22] Filed: Feb. 8, 1982

[51] Int. Cl.[3] ..... B21D 28/36

[52] U.S. Cl. ..... 72/69; 72/71; 72/325

[58] Field of Search ..... 72/69, 70, 71, 325; 148/12.4, 149

[56] References Cited

U.S. PATENT DOCUMENTS

| | | | |
|---|---|---|---|
| 1,675,910 | 7/1928 | Riker | 72/325 |
| 1,813,152 | 7/1931 | Enghauser | 29/33 |
| 1,906,953 | 5/1933 | Enghauser | 29/156.4 |
| 2,991,551 | 7/1961 | Fogle et al. | 29/545 |
| 3,429,171 | 2/1969 | Feher | 72/325 |
| 3,939,683 | 2/1976 | van Geffen | 72/71 |
| 4,132,097 | 1/1979 | Ames | 72/71 |
| 4,175,413 | 11/1979 | van Geffen | 72/71 |
| 4,177,659 | 12/1979 | van Geffen | 72/71 |
| 4,185,486 | 1/1980 | van Geffen | 72/71 |

FOREIGN PATENT DOCUMENTS

| | | | |
|---|---|---|---|
| 2343432 | 3/1975 | Fed. Rep. of Germany | 72/325 |
| 55-100842 | 8/1980 | Japan | 72/325 |
| 762185 | 11/1956 | United Kingdom | 148/149 |
| 637178 | 12/1978 | U.S.S.R. | 72/69 |

OTHER PUBLICATIONS

"Machine and Tool Blue Book", Oct. 1979, Make Holes and Bushings in One Operation. (pp. 116–121).

*Primary Examiner*—Lowell A. Larson

[57] ABSTRACT

A flow drilling tool including a blunt-ended prepunch portion for punching a circular slug from the workpiece as the tool is rotated and moved axially with respect to the workpiece. Thereafter, a circular forming portion is rotated in contact with the workpiece to increase the length and diameter of the punched hole. The prepunch permits formation of a rimmed hole in a single step by eliminating predrilling. Variations and irregularities in the length and thickness of the rim portion surrounding the hole are reduced, and ragged tapered surfaces on the rim portion are eliminated. The axial location of the hole relative to the workpiece is controlled by adjusting the speed of rotation of the tool and the axial pressure of the tool against the workpiece, and by preheating the workpiece.

47 Claims, 6 Drawing Figures

FLOW DRILLING PROCESS AND TOOL THEREFOR

BACKGROUND OF THE INVENTION

The present invention relates generally to a flow drilling process and tool, and more particularly to a flow drilling process and tool for reliably forming a strong, uniform rimmed hole or boss in a metal workpiece.

Various types of piercing and drilling processes and tools have been devised in the past for making rimmed or bossed holes in metal workpieces. For example, in U.S. Pat. Nos. 1,813,152 and 1,906,953 issued in the name of W. L. Enghauser in 1931 and 1933, respectively, a method and apparatus are disclosed for forming tap holes in relatively thin-walled gas pipe. The pipe is predrilled to center a rapidly rotating spinning tool which heats the metal to a forming temperature and spreads the metal along the tool to form bosses in both directions. A process and tool similar to that shown by Enghauser is described in U.S. Pat. No. 2,991,551 issued to H. D. Fogle et al in 1961. However, to form more uniform peripheral rims in a single pass, Fogle discloses a tubular slug forming tool having a sharpened cylindrical cutting end. In U.S. Pat. No. 3,429,171 issued to J. J. Feher in 1969, a spinning tool is described which includes an end portion tapering to a sharp point for piercing relatively soft metal without heating.

The above-mentioned processes and tools are primarily for forming holes in relatively soft metals and are not well adapted for use with harder metals. Processes requiring predrilling usually require at least one extra step, and centering the holes with respect to the workpiece is a common problem if precise hole location is necessary. Similarly, a tubular slug-forming tool such as shown in Enghauser, although capable of reducing rim and hole length irregularities, is difficult to center, and the cutting end requires frequent sharpening when used with anything but the softest materials. The slug can become lodged in the tubular cutting portion.

More recently a flow drilling process and tool were devised for forming holes and bushings in harder metals such as iron and mild steel. The tool, described in U.S. Pat. No. 3,939,683 issued to J. A. Van Geffen in 1976, has a specially shaped conical nose with several shallow flats produced axially along its periphery. The tool and process is further described in an article entitled "Make Holes and Bushings in One Operation" appearing at pages 117–121 of the October 1979 issue of the Machine and Tool Blue Book incorporated herein by reference for background information. The rim or boss portion of the bushing formed by the Van Geffen process on the downward side of the workpiece tapers to a wavy or relatively ragged surface with numerous locations where cracks or stress risers form. As a result, bushing length is irregular, and shear stress can easily crack the bushing. Metal flow above and below the hole formed by the initial penetration of the tool is relatively fixed at about 40 percent upward and 60 percent downward, and controlling bushing length has required a separate step such as trimming, predrilling or countersinking. The tool must be specially fabricated to achieve the desired cross-sectional configuration with the shallow flats along the periphery.

It is therefore an object of the present invention to provide an improved flow drilling process, and tool therefor.

It is another object to provide a flow drilling process, and tool therefor, which overcome the problems set forth above.

It is a further object to provide a flow drilling process, and tool therefor, for providing a bossed or rimmed hole of uniform length and increased strength. It is another object to provide such a process and tool which obviate predrilling or trimming steps, and wherein the tool has increased lifetime and does not require sharpening.

It is still another object to provide flow drilling process and tool wherein the length and axial location of the hole, as well as wall thickness, can be predictably controlled. It is a further object to provide such a process and tool wherein the tool can be accurately centered on the workpiece to precisely locate the hole.

It is also an object of the invention to provide a flow drilling tool which is capable of forming a bossed or rimmed hole devoid of ragged and excessively tapered surfaces. It is another object to provide such a tool, and a process utilizing the tool, for forming the hole in a single operation without need to predrill or to cut a slug with a sharpened cutting end.

It is yet another object to provide a tool for efficiently and cleanly punching a circular slug from a relatively hard metal workpiece. It is a further object to provide such a tool with a forming portion for increasing the axial length and diameter of the punched hole, wherein the forming portion is substantially circular in cross section to simplify fabrication of the tool.

A flow drilling tool includes a cylindrically-shaped prepunch portion having a relatively blunt cone-shaped free end terminating in an apex located on the axis of the tool. Preferably the apex angle is between 60 and 85 degrees. A circular-forming portion located axially rearwardly of the prepunch portion tapers radially outwardly therefrom to an enlarged end having a radius approximately equal to the desired radius of the finished hole.

The flow drilling tool is rotated at relatively high speed as it is forced with constant pressure against a metal workpiece. Initially the apex locates the tool on the workpiece, and, as the prepunch portion is rotated, the metal softens adjacent the free end of the prepunch portion. The constant axial pressure applied to the tool and acting against the softened metal forces a circular slug from the workpiece. The resulting punched hole is enlarged radially and axially as the forming portion heats and spins the adjacent metal to form bosses or rims on each side of the workpiece.

Boss or rim integrity and appearance and hole length uniformity are improved by removing, in the form of the circular slug, the metal which is first softened by the tool and which would form a ragged edge if not removed. The blunt prepunch requires no sharpening, and the diameter of the prepunch can be varied to change the axial length of the finished hole. The final location of the hole can be controlled more closely than with a process wherein pilot holes are first drilled, and the hole can be completely formed in a single operation with one stroke of the rotating tool.

The flow drilling process also includes the step of selectively preheating an area of the workpiece, as well as controlling tool speed and feed pressure, to control metal flow above and below the workpiece. This allows all or nearly all of the metal shaped by the forming portion to be used for the wall thickness and eliminates need for trimming. Also, the location of the final attachment point of the slug to the workpiece is controlled by preheating the workpiece off-center from the axis of the tool so that axially aligned bushings can be simultaneously formed in opposed tubing walls by a pair of tools without slug interference.

While the bushing is still hot from the forming process, a quenching step can be performed to provide a hard bearing surface without a subsequent reheating step. A shield is interposed between the workpiece and the flow drilling tool, and the finished hole is sprayed with a quench solution.

These and other objects, features and advantages of the present invention will become apparent from the description of the preferred embodiment and from the drawings.

Figure 1:
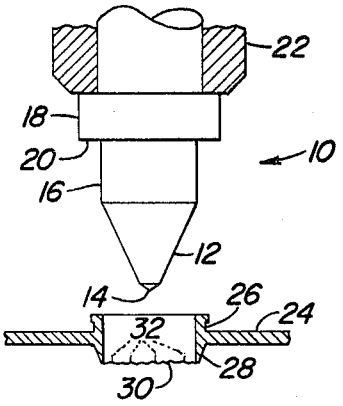
FIG. 1 (PRIOR ART)
FIG. 1 is a side view partially in section of a flow drilling tool typical of the prior art, and a rimmed hole formed by the tool.

Referring first to FIG. 1, therein is shown a flow drilling tool 10 typical of the prior art. The tool 10 has a tapered portion 12 tapering to a center point 14. A generally cylindrical portion 16 is located between the tapered portion 12 and a circularly cylindrical portion 18 with a shoulder 20. The tool 10 is clamped in a chuck 22 and, while rotated at high speeds, is pushed into a workpiece 24 to make an initial indentation. Friction heats the workpiece 24, and the tool 10 penetrates to open a hole and further expose the metal to flats (not shown) formed on the nose of the tool. As the metal reaches the plastic stage, approximately 40 percent is extruded upwardly to form an upper boss or rim 26 which is flattened by the shoulder 20, and the remainder is extruded downwardly to form a tapered lower boss or rim 28 having a relatively wavy edge 30 wherein cracks or stress risers may form at locations indicated generally at 32.

Figure 2:
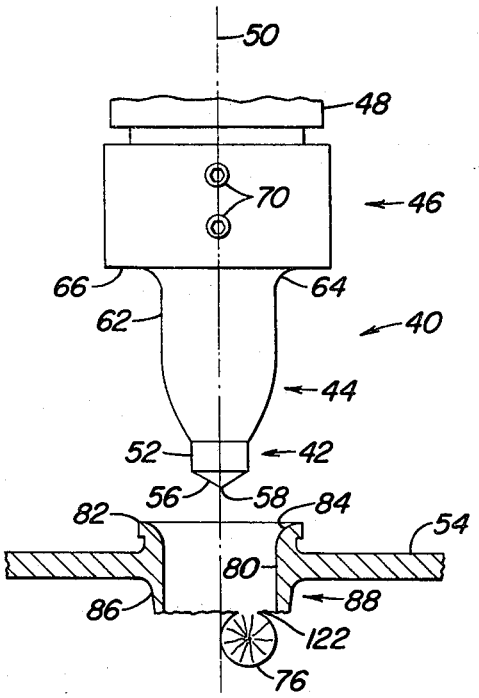
FIG. 2 is a side view of the flow drilling tool of the present invention and a rimmed hole formed by the tool.

Referring now to FIG. 2, therein is shown one embodiment of a forming tool 40 constructed in accordance with the principles of the present invention. The tool 40 includes a lower, axially forward prepunch portion 42, an intermediate tapered forming portion 44 substantially circular in cross section and increasing in diameter in the axially rearward direction, and an upper portion 46 adapted for connection to a rotatable drive or chuck member 48 for rotation of the tool 40 about its central axis 50. Preferably the tool 40 is fabricated from a standard carbide material, grade 55A or the like, although ceramic material or other materials having high strength and heat resistance may also be used. Softer material, such as ordinary tool steel, may be used for the upper portion 46.

The prepunch portion 42 includes a circular cylindrical portion 52 with the axis of the cylinder corresponding to the central axis 50. In the preferred embodiment, the axial length of the cylindrical portion 52 is at least approximately equal to the thickness of the workpiece 54 at the desired hole location. The cylindrical portion 52 terminates at its lower or axially forward end in a relatively blunt, cone-shaped free end 56. The apex or point 58 of the free end is located on the central axis 50 to precisely locate the tool 40 with respect to the desired hole center location on the workpiece 54. The apex angle $\alpha$ (FIG. 4), that is, the angle that the surface of the cone forms with respect to the central axis 50, is preferably relatively large so that the free end 56 is relatively blunt to prevent the prepunch portion 42 from piercing the workpiece 54 when the prepunch is initially pressured into contact with the workpiece. However, it has been found that as the apex angle $\alpha$ closely approaches 90 degrees, that is to say, as the free end approaches a flat condition, centering of the tool 40 with respect to the workpiece becomes increasingly difficult and unpredictable. The optimum apex angle range is from a minimum of about 60 degrees to a maximum of about 85 degrees. Below an apex angle of about 60 degrees, the prepunch 42 will tend to overly deform the workpiece 54 downwardly, as shown by the dimension D in FIG. 4. Preferably the dimension D is relatively insignificant and less than a few thousandths of an inch. Above an apex angle of about 85 degrees, the tool 40 will hunt or slide around as the prepunch 42 contacts the upper surface of the workpiece 54. The preferred apex angle has been found to be about 75 degrees.

The forming portion 44 preferably has a circular cross section with a diameter, at its juncture with the prepunch portion 42, equal to the diameter of the cylindrical portion 52. In the embodiment shown in FIG. 2, the forming portion 44 tapers radially outwardly from the prepunch portion 42 and is generally bullet-shaped. The upper or axially rearward surface 62 of the forming portion 44 is generally cylindrical but tapers outwardly at radius 64 to a juncture with a downwardly directed shoulder 66 on the upper portion 46. Set screws 70 or other suitable connecting structure secure the upper portion 46 for rotation with the drive member 48 about the central axis 50.

Figure 4:
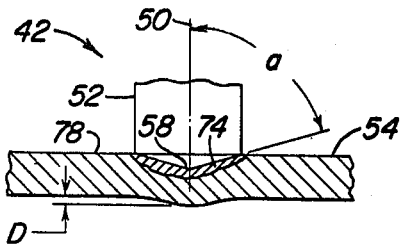
FIG. 4 is an enlarged view of the prepunch portion of the tool of the present invention as it is rotated against a workpiece.

In operation, the tool 44 (FIG. 2) is rotated at relatively high speed about its axis 50. The tool 44 is pressed axially forwardly relative to the workpiece 54, and the point 58 centers the tool at the desired location. The rotating prepunch 42 heats and softens the metal 74 (FIG. 4) adjacent the end 56. As the metal softens, constant axial pressure applied by the tool 40 forces the prepunch 42 downwardly to punch out a circular slug 76 and form a punched hole in the workpiece. The circular cylindrical portion 52 has sufficient axial length to force the slug 76 substantially through the thickness of the workpiece 54 before the tapered forming portion 44 contacts the metal. The shape of the prepunch 42 provides a punching action, as opposed to a piercing or metal-forming action, to punch the initial hole without significant deformation or extrusion of the adjacent metal 78 (FIG. 4). Thereafter, the rotating forming portion 44 heats the metal to a plastic state and causes the metal to flow axially in both directions and form around the surface of the forming portion 44. The continuously applied axial pressure causes the tool 40 to progress through an entire hole-forming stroke as the metal softens. In the embodiment shown in FIG. 2, the upper surface 62 of the forming portion 44 is cylindrical so that a straight hole 80 is formed upon completion of the stroke. The radius 64 and the shoulder 66 cooperate, as the forming stroke of the tool 40 reaches its axially forwardmost or lowermost position, to form an upper rim 82 with a radius 84 on the tool-side of the workpiece 54.

A lower rim 86 is formed on the opposite side of the workpiece 54. The metal 74, which is initially heated by the prepunch 42, is substantially removed with the slug 76 from the portion of the workpiece which is subsequently formed by the portion 44; therefore, a ragged and wavy lower edge, typical of holes formed with many prior art tools, is eliminated from the lower rim 86. The prepunch operation also reduces the amount of taper of the lower rim 86 to increase the strength of rimmed hole or bearing structure 88.

Various combinations of hole and rim shapes can be obtained by varying the shape of the forming portion 44. In an alternate embodiment of the tool (40*a* of FIG. 3), the forming portion 44 has a straight tapered upper surface 62*a* to form a straight tapered hole 80*a* in the workpiece 54. Eliminating the radius at the juncture of the forming portion 44*a* with the shoulder 66 results in an upper rim 82*a* with an angle 92 rather than a radius. The bearing structure 88 in FIG. 2 can be formed with a square-shouldered bushing by eliminating the radius 64. In the embodiment shown in FIG. 3, the forming portion 44 includes the upper surface 62*a* and straight tapered lower surface 94, wherein the lower surface 94 tapers outwardly at a larger angle with respect to the central axis 50 than does the surface 62*a*. Other forming portion shapes may also be utilized, and the above are given by way of example only. For example, the surface 94 can be rounded rather than straight. The juncture of the portions 62*a* and 94 can be formed with a radius rather than as shown.

The surface 62 determines the final shape and diameter of the hole 80. The diameter of the prepunch portion 42 affects the axial length of the hole, since the diameter of the slug 76 is approximately equal to the prepunch diameter, and as more metal is removed from the workpiece 54 in the form of the slug 76, less metal will be available to form the rimmed hole or bearing structure 88.

Figure 3:
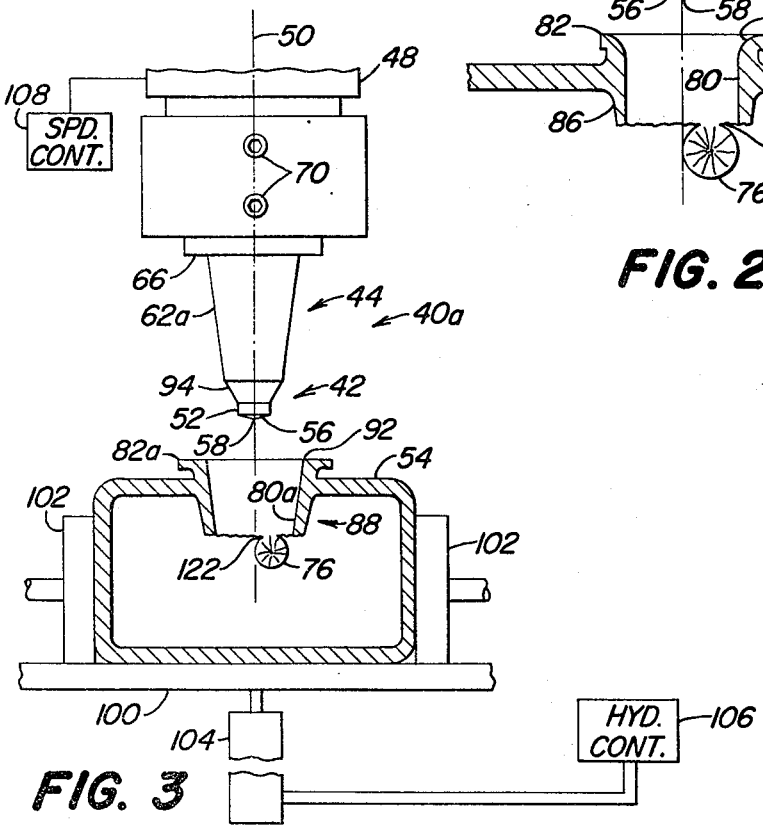
FIG. 3 is a side view similar to that shown in FIG. 2, but showing a flow drilling tool having a tapered forming portion, and also including the workpiece support and control, and the tool speed control.

In the preferred embodiment, the rotating tool 40 is maintained stationary in the axial direction, and the workpiece 54 is moved in the direction of the tool axis into contact with the tool by a hydraulic feed table 100 (FIG. 3). The workpiece 54 is secured to the table 100 below the tool 40 by clamping structure 102. As the tool 40 is rotated at high speed, the table is raised by a hydraulic cylinder 104 and the workpiece 54 is pressed into contact with the prepunch portion 42. In the preferred embodiment, a constant axial pressure is maintained between the tool 40 and the workpiece 54 by a conventional hydraulic pressure control 106 operably connected to the cylinder 104. The pressure is adjusted at the control 106. An increase in pressure during forming permits more metal to flow downwardly with respect to the surface of the workpiece 54, while a decrease in pressure permits more metal to flow upwardly. An increase in pressure causes increased friction between the prepunch 42 and the workpiece 54 to produce faster and more localized heating of the area. The localized heating reduces the tendancy of the metal to flow upwardly around the rapidly spinning tool 40. A decrease in pressure slows heating and permits the heat to soak into the adjoining area which results in increased upward flow of the metal around the tool. Therefore, by controlling the pressure, the axial displacement of the bearing structure 88 with respect to the workpiece 54 can be controlled.

The RPM of the rotating member 48 is controlled by a conventional speed control 108. Increasing the speed causes the forming tool 40 to heat the workpiece 54 faster to thereby localize the area heated and reduce the tendancy of the metal to flow upwardly around the spinning tool. Decreasing the speed slows the heating process and permits the heat to soak into the adjoining area which results in increased upward flow of metal around tool.

Figure 5:
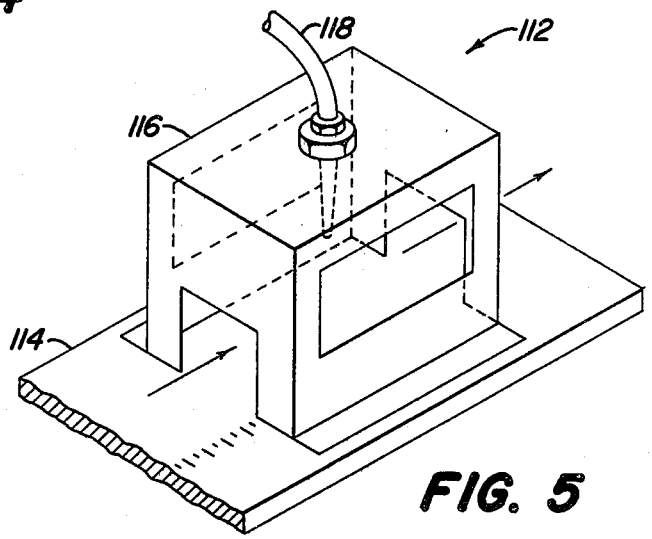
FIG. 5 is a perspective view of structure for preheating a selected portion of a workpiece.

Both table pressure and tool RPM can be simultaneously controlled to control metal flow in the axial direction to achieve the desired axial offset of the structure 88 with respect to the surface of the workpiece 54. In addition, the workpiece can be preheated generally throughout its thickness at the desired hole location, by heating structure such as at 112 (FIG. 5), to increase the upward flow of metal around the tool 40 during forming. Although the worktable 100 is shown to provide the relative axial movement between the tool 40 and the workpiece 54, it is to be understood that such movement can also be achieved by moving the tool 40 axially with respect to a stationary workpiece.

The heating structure 112 includes a base 114 and a locating member 116. A spot-heating device 118 is supported by the member 116. The workpiece 54 is positioned in the locating member 116 with the spot heater 118 directly above the desired hole location in the workpiece. The spot heater 118, which in the preferred embodiment is a spot welder, is adjustable with respect to the workpiece 54.

The location of the final area of connection 122 (FIGS. 2 and 3) of the slug 76 to the workpiece is determined by the heat profile of the workpiece and can be controlled by the preheating step in the structure 112. By locating the heated area off-center with respect to the axis 50, connection 122 of the slug 76 will predictably coincide with the coolest area at the edge of the slug. For example, if the preheated area is offset to the left with respect to the hole center location, the connection 122 will be offset to the right. Two axially aligned holes can therefore be formed in closely spaced opposed sidewalls of a tube by a pair of tools 40, without the slugs 76 interferring with each other, by offsetting the preheated areas for the holes in opposite directions. The slugs 76 are easily removed from the lower rims by bending back or lightly impacting the slugs.

In a thick-walled workpiece 54, the lower side, or side opposite the upper side which faces the tool, can be preheated to a higher temperature than the upper side to increase metal flow downwardly, that is, in the direction of advancement of the tool. There must be a temperature differential between the sides to provide a downward axial displacement of the structure 88. If the upper side is preheated to a temperature generally equal to or above that of the lower side, more metal will tend to flow upwardly, or toward the side of the workpiece facing the tool.

Figure 6:
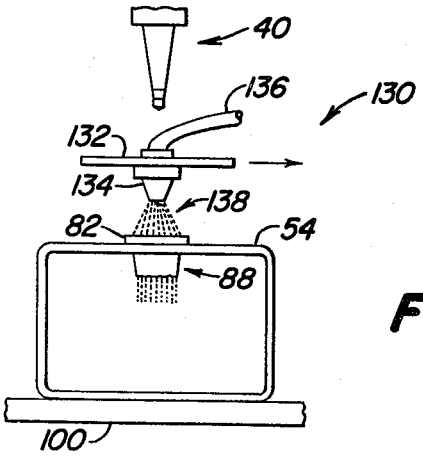
FIG. 6 is a partial side view of a quenching apparatus positioned between the flow drilling tool and the rimmed hole formed thereby.

During the forming operation, the area of the workpiece adjacent the tool 40 is heated to a temperature above the critical temperature of the metal. Quenching structure 130 (FIG. 6) is provided above the worktable 100 for quickly cooling the structure 88 immediately after being formed to thereby harden the surface to make it suitable for use as a bushing. The quenching structure includes a shield 132 supported with respect to the worktable 100 for movement to and from a quenching position shown in FIG. 6. A spray nozzle 134 is connected to the shield, and to a source of quench solution via conduit 136. Immediately after the hole-forming stroke of the tool 40 is complete, the cylinder 104 is retracted to lower the table 100 and the workpiece 54, and the shield 132 is moved in place between the tool 40 and the workpiece 54. A spray 138 of quench solution is directed from the nozzle 134 to the structure 88 to cool and harden the bearing surface. The shield 132 prevents quench solution from hitting and cracking the tool 40, which is heated to a very high temperature during the forming step.

To increase temperature stability and wear resistance, the tool 40 is given a coating of hafnium nitride, preferably about ten microns thick. The tool is very rugged and can penetrate metal with a Rockwell hardness of up to about 60. The relatively blunt-ended prepunch 42 can withstand high temperatures and does not require sharpening. The prepunch 42 easily centers the tool on the workpiece 54 and eliminates problems with slug sticking. A strong bearing structure can be formed with a single forming stroke of the tool.

Having described the preferred embodiment, it will be apparent that modifications can be made without departing from the scope of the invention as defined in the accompanying claims.

We claim:

1. A forming tool for simultaneously forming a hole and a bushing in a metal workpiece of preselected thickness, said tool comprising an elongate member having a central axis, a first end portion adapted to be mounted in a drive and rotated about the central axis as the tool and the workpiece are moved axially with respect to each other, an opposite end portion having a cylindrically-shaped barrel portion terminating in a free blunt end, said end being substantially solid and generally cone-shaped with an apex located on the central axis for centering the tool, said end portion adapted to be rotated in frictional contact with the workpiece while pressed axially against the workpiece to soften the metal adjacent the blunt end and form a slug, a circular forming portion located between the ends and offset axially from the blunt end at least a distance equal to the thickness of the metal, said forming portion tapering radially outwardly from the barrel portion toward the first end portion and adapted to be rotated about the axis in frictional contact with the workpiece subsequent to the formation of the slug to fluidize the metal adjacent said forming portion and form a bushing having a maximum inner diameter substantially equal to the maximum diameter of the forming portion contacting the metal.

2. The forming tool as set forth in claim 1 wherein the apex angle of the opposite end portion is greater than about 60 degrees but less than about 85 degrees.

3. The forming tool as set forth in claim 2 wherein the apex angle is approximately 75 degrees.

4. The forming tool as set forth in claim 1 wherein the tool is fabricated from ceramic material.

5. The forming tool as set forth in claim 1 wherein the tool is fabricated from carbide and includes a coating of hafnium nitride for temperature stability and wear resistance.

6. The forming tool as set forth in claim 1 or 2 wherein the first end portion includes a stepped portion defining a generally axially facing forming surface for contacting the fluidized metal adjacent the forming portion.

7. The forming tool as set forth in claim 6 wherein the forming portion includes a cylindrically-shaped portion adjacent the stepped portion and rotatable about the axis, said portions cooperating to form a square-shouldered bushing.

8. The forming tool as set forth in claim 6 wherein the forming portion is fabricated from carbide, and the stepped portion is fabricated from a tool steel of less hardness than the carbide.

9. A forming tool for simultaneously forming a hole and a bushing in a metal workpiece of preselected thickness, said tool having a central axis of rotation and wherein said tool and the workpiece are adapted to be moved axially with respect to each other, a first end adapted to be connected to a drive for rotation of the tool about its axis, a second end having a prepunch portion terminating in a blunt cone-shaped free end portion having an apex on the central axis for centering the tool against one side of the workpiece, said prepunch portion adapted to be rotated in frictional contact with the workpiece and moved axially thereagainst to punch out a circularly shaped slug, and forming means located between the prepunch portion and the first end and tapering radially outwardly from said prepunch portion and adapted for rotation in frictional contact with the workpiece subsequent to the formation of the slug for fluidizing the metal adjacent said forming means and forming a bushing having a maximum inner diameter greater than the diameter of the slug and having a metal content substantially free of the metal in the slug.

10. The forming tool as set forth in claim 9 wherein the prepunch portion includes a cylindrical body portion with an axis corresponding to the central axis of rotation, said cylindrical body portion having an axial length equal to or greater than the preselected thickness of the workpiece for pushing the slug generally past the opposite side of the workpiece prior to formation of the bushing.

11. The forming tool as set forth in claim 9 or 10 wherein the cone-shaped free end portion has an apex angle between 60 and 85 degrees.

12. The forming tool as set forth in claim 9 or 10 wherein the cone-shaped free end portion defines a substantially smooth and continuous surface.

13. A forming tool adapted for rotation by a drive member for forming a hole and a bushing substantially centered on a preselected point in a metal workpiece of preselected thickness, said tool comprising a forming portion having a central axis, means connecting the forming portion to the drive member for rotation about the central axis while in pressured contact with the workpiece to frictionally heat and form the metal, a prepunch portion connected to the body portion axially in advance thereof for rotation therewith and having a circular cylindrically-shaped portion terminating in a blunt free end converging to an apex, wherein the axis of said circular portion and the apex lie on the central axis, said apex for centering the tool on the preselected point as the free end is rotated in frictional contact with the workpiece, and wherein the body portion and free end cooperate to form a removable slug prior to formation of the bushing by the forming portion as the tool is rotated and pressed axially through the workpiece.

14. The forming tool as set forth in claim 13 wherein the free end portion comprises a substantially solid cone having an apex angle between 60 and 85 degrees.

15. The forming tool as set forth in claim 13 or 14 wherein the tool includes a coating of hafnium nitride for temperature stability and wear resistance.

16. The forming tool as set forth in claim 13 or 14 wherein the prepunch portion has an axial length at least substantially equal to the preselected thickness of the workpiece.

17. The forming tool as set forth in claim 15 wherein the tool is composed primarily of carbide material.

18. Apparatus for forming a rimmed hole in a preselected location of a workpiece, said apparatus comprising:

an elongated forming tool having a central axis, a first end and a free end, said elongated tool also having a forming portion tapering radially outwardly in an axially rearward direction from a location between the ends towards the first end, said elongated member also including a prepunch portion axially in advance of the forming portion, said prepunch portion including means for locating the tool with respect to the workpiece including an axially leading point located on the central axis, said prepunch portion also including a cylindrical body with an axis coinciding with the central axis and a generally continuous surface tapering axially rearwardly from the point to the outer surface of the cylindrical body;

drive means connected to the first end for rotating the forming tool about the central axis; and means for pressing the tool axially forwardly relative to the workpiece while in rotational frictional contact with the workpiece to first heat an area adjacent the prepunch and punch out a slug and thereafter heat and fluidize an area adjacent the forming portion to axially displace the fluidized material.

19. The apparatus as set forth in claim 18 including heating means for preheating a portion of the preselected area to control the axial displacement adjacent the forming portion.

20. The apparatus as set forth in claim 19 wherein the heating means comprises a spot welder.

21. The apparatus as set forth in claim 19 or 20 wherein the heating means includes means for localizing the heated area off-center with respect to the central axis to control the location of the final area of connection of the slug to the workpiece.

22. The apparatus as set forth in claim 18 wherein the means for pressing the tool axially forwardly comprises a hydraulically movable worktable supporting the workpiece including hydraulic control means for moving the worktable and maintaining a substantially constant preselected pressure between the forming tool and the workpiece.

23. The apparatus as set forth in claim 22 wherein the hydraulic control means includes means for adjusting the preselected pressure to control the axial displacement of the fluidized material.

24. The apparatus as set forth in claim 22 or 23 further comprising means operably associated with the drive means for adjusting the speed of rotation of the forming tool to control the axial displacement of the fluidized material.

25. The apparatus as set forth in claim 18 further comprising means for quenching the fluidized area immediately after axially displacing the material.

26. The apparatus as set forth in claim 25 wherein the means for quenching includes a source of quench liquid, and a shield interposed between the forming tool and the source of liquid to prevent rapid cooling of the tool by the liquid.

27. Apparatus for forming a rimmed hole in a metal workpiece of preselected thickness, said apparatus comprising:

a forming tool having a central axis with an axially rearward end and an axially forward end, said forward end comprising a punch having a substantially cylindrically-shaped body terminating in a relatively blunt free end, said body including an axis corresponding to the central axis and having an axial length at least approximately equal to the preselected thickness, said forming tool also including generally circularly-shaped forming structure tapering radially inwardly from a first portion adjacent the rearward end toward a second portion adjacent the punch, said first portion having an effective radius greater than the radius of the punch body, wherein the blunt free end of the punch comprises cone-shaped structure having an apex lying on the central axis with an apex angle of between sixty and eighty-five degrees;

means for causing axial movement of the tool relative to the workpiece to punch a circular slug generally through the thickness of the metal and press the forming structure into contact with the workpiece; and means for rotating the forming structure in frictional contact with the workpiece to fluidize and form metal adjacent said structure.

28. The apparatus as set forth in claim 27 wherein the means for rotating the forming structure also rotates the tool during axial movement of the punch for heating and softening the metal adjacent the punch.

29. The apparatus as set forth in claim 28 wherein the means for causing axial movement includes means for applying constant pressure between the tool and the workpiece.

30. A method of forming a rimmed hole in a metal workpiece, including the steps of:

locating a tool with a central axis at a preselected location on the workpiece, said tool including a circular punch portion with a relatively blunt, cone-shaped end having an apex on the axis for centering the tool at the preselected location, and a forming portion;

advancing the punch portion with respect to the workpiece and punching out a slug to provide a hole in the workpiece;

rotating the forming portion about the central axis in frictional contact with the metal adjacent the hole to fluidize the metal and extend the axial length and diameter of the hole.

31. The method set forth in claim 30 further including the step of rotating the punch portion in frictional contact with the workpiece to soften the metal adjacent the punch portion during the step of advancing.

32. A method of forming a rimmed hole in a generally flat portion of a workpiece, including the steps of:

rotating an elongated tool about its longitudinal axis, said tool having a circular blunt-ended punch portion with a point located on the axis, and a forming portion axially rearward of the punch portion and extending radially outwardly thereof;

centering the tool with respect to the workpiece, said step of centering including pressing the point against the workpiece; and pressing the centered tool axially into contact with the flat portion of the workpiece during the step of rotating, said step of pressing the centered tool including punching a circular hole in the workpiece and thereafter fluidizing a portion of the workpiece adjacent the punched hole to extend the axial length and diameter of the hole.

33. The method as set forth in claim 32 wherein the step of punching includes forming a circular slug with a relatively insignificant amount of indentation at its center.

34. The method as set forth in claim 32 further including the step of controlling the axial displacement of the extended hole, said step including preheating the area of contact of the workpiece and tool prior to the step of pressing the centered tool.

35. The method as set forth in claim 34 wherein the step of controlling includes:

preheating one side of the workpiece to a temperature above the temperature of the immediately adjacent opposite side to increase the axial length of the hole in the direction of said one side.

36. The method as set forth in claim 33 further including the step of:

predetermining the location of the final area of connection of the slug to the workpiece by preheating the area of contact of the workpiece and the tool off-center from the axis of rotation of the tool.

37. A method of forming a hole in a thickness of a metal workpiece, the hole having an axial length greater than said thickness, the method comprising the steps of:

(a) providing a tool having a central axis, an axially forwardly-located cylindrical punch portion with a cone-shaped blunt end, and a forming portion axially rearward of and radially outward of the punch portion;

(b) forcing the punch portion of the tool axially against the workpiece and punching a slug from the workpiece to form a hole therein while preventing substantial deformation of the metal adjacent said hole; and (c) after the step of forcing, rotating the tool about its axis with the forming portion in frictional contact with the workpiece adjacent the hole to heat and fluidize the metal and increase the axial length and diameter of the hole.

38. The method as set forth in claim 37 wherein step (b) includes:

heating the workpiece to soften the workpiece in the area of contact between the punch portion and workpiece by rotating the tool.

39. The method as set forth in claim 37 or 38 wherein the step (b) includes:

punching a circular slug from the workpiece having an insignificant amount of indentation at its center.

40. The method as set forth in claim 38 wherein during step (b) the area radially outwardly of the area of contact of the punch portion and workpiece is maintained below the temperature at which the metal begins to form around the tool.

41. The method as set forth in claim 38 wherein the step (b) includes advancing the tool axially with respect to the workpiece with substantially constant pressure.

42. The method as set forth in claim 41 wherein the step (c) includes the step of advancing the forming portion with substantially constant pressure, said pressure chosen in accordance with desired axial displacement of the hole with respect to workpiece.

43. The method as set forth in claim 37 wherein step (c) includes heating the metal above critical temperature, and further including the step of quenching metal fluidized by the tool adjacent the hole after step (c) and before the heated area cools, to form a hardened bearing surface.

44. The method as set forth in claim 43 including the steps of:

locating quench solution spray structure adjacent the workpiece, interposing a protective shield between the tool and the spray structure to prevent the tool from being rapidly cooled by spray from the spray structure, and spraying the workpiece with the quench solution.

45. The method as set forth in claim 38 or 42 further including the step of controlling the speed of rotation of the tool to control the axial displacement of the hole with respect to the workpiece.

46. The method as set forth in claim 45 including the step of further controlling the axial displacement of the hole with respect to the workpiece by preheating one side of the workpiece to a temperature substantially above the temperature of the opposite side to cause increased flow of fluidized metal toward said one side.

47. Apparatus for forming a rimmed hole in a metal workpiece of preselected thickness, said apparatus comprising:

a forming tool having a central axis with an axially rearward end and an axially forward end, said forward end comprising a punch having a cylindrical body terminating in a relatively blunt free end, said body including an axis corresponding to the central axis and having an axial length at least approximately equal to the preselected thickness, said free end terminating in an axially forwardmost apex on said axis for locating the tool on the workpiece, said forming tool also including generally circularly-shaped forming structure tapering radially inwardly from a first portion adjacent the rearward end toward a second portion adjacent the punch, said first portion having an effective radius greater than the radius of the punch body;

means for causing axial movement of the tool relative to the workpiece to punch a circular slug generally through the thickness of the metal and press the forming structure into contact with the workpiece; and means for rotating the forming structure in frictional contact with the workpiece to fluidize and form metal adjacent said structure.

* * * * *